United States Patent [19]

Boutin-Lester

[11] Patent Number: 4,955,271

[45] Date of Patent: Sep. 11, 1990

[54] LETTUCE AND VEGETABLE CUTTING DEVICE

[76] Inventor: Paige L. Z. Boutin-Lester, 8205 62nd Street Ct. East #1602, Sarasota, Fla. 34243

[21] Appl. No.: 429,698

[22] Filed: Oct. 31, 1989

[51] Int. Cl.[5] ..... B26D 3/26

[52] U.S. Cl. ..... 83/404.3; 83/431; 83/858

[58] Field of Search ..... 83/404.3, 749, 408, 83/431, 856, 857, 858

[56] References Cited

U.S. PATENT DOCUMENTS

| | | | |
|---|---|---|---|
| 4,062,260 | 12/1977 | Steinhogl | 83/404.3 |
| 4,573,384 | 3/1986 | Jones | 83/404.3 |
| 4,608,896 | 9/1986 | Topp | 83/431 |

FOREIGN PATENT DOCUMENTS

| | | | |
|---|---|---|---|
| 2119992 | 10/1972 | Fed. Rep. of Germany | 83/408 |
| 521372 | 3/1955 | Italy | 83/431 |
| 1472450 | 5/1977 | United Kingdom | 83/408 |

*Primary Examiner*—Frank T. Yost
*Assistant Examiner*—John M. Husar
*Attorney, Agent, or Firm*—Charles J. Prescott

[57] ABSTRACT

A lettuce and vegetable cutting device structured to section a head of lettuce or the like into a plurality of lengths or sections each having a different cross section for variety in appearance and edibility. The device includes a tubular cylindrical upright frame, a cutting grid, and a ram or pusher. The frame is structured to retain, or have connected at a mid point within the upright length of the frame, the cutting grid in a horizontal orientation. The cutting grid includes a plurality of connected, edgewise upright cutting blades each having upwardly facing cutting edges which define a plurality of non-uniform apertures. The ram is utilized to exert downward pressure on the head of lettuce atop the cutting grid and within the frame thus forcing the lettuce head downwardly through the cutting grid. The frame extends upwardly above the cutting grid to laterally constrain the lettuce head. Structure is also provided for properly orienting and guiding the ram in its downward travel within the frame. The lower surface of the ram may also include grid recesses or grooves into which the cutting blades matably fit to both insure full sectioning of the lettuce head and to also optionally prevent contact and dulling of the blades against the ram.

8 Claims, 1 Drawing Sheet

LETTUCE AND VEGETABLE CUTTING DEVICE

BACKGROUND OF THE INVENTION

The present invention relates generally to devices for slicing or shredding heads of lettuce and other vegetables of like kind, and more particularly to a device for providing a wide variety of sectioned sizes produced from a single head of lettuce.

Many devices have been developed and marketed for cutting, slicing, shredding or sectioning vegetables. Various devices, for example, are utilized to produce french fried potatoes.

One type of vegetable, i.e. lettuce and cabbage, has drawn some inventive attention as exemplified in U.S. Pat. No. 3,587,687 to Hill which discloses an apparatus for shredding lettuce, cabbage and the like on a commercial or institutional basis. Another such commercial device is disclosed in U.S. Pat. No. 3,765,288 to Giangiulio which is directed to a multi-purpose cutting device which both shreds and dices lettuce and various other types of low density produce.

The present invention is directed to a simple and economical home use-type device which will quickly produce sectioned lettuce, cabbage and the like manually, which sections are non-uniform in size and shape so as to afford variety in both appearance in edibility of the sections produced by this invention.

BRIEF SUMMARY OF THE INVENTION

This invention is directed to a lettuce and vegetable cutting device structured to section a head of lettuce or the like into a plurality of lengths or sections each having a different cross section for variety in appearance and edibility. The device includes a tubular cylindrical upright frame, a cutting grid, and a ram or pusher. The frame is structured to retain, or have connected at a mid point within the upright length of the frame, the cutting grid in a horizontal orientation. The cutting grid includes a plurality of connected, edgewise upright cutting blades each having upwardly facing cutting edges which define a plurality of non-uniform apertures. The ram is utilized to exert downward pressure on the head of lettuce atop the cutting grid and within the frame thus forcing the lettuce head downwardly through the cutting grid. The frame extends upwardly above the cutting grid to laterally constrain the lettuce head. Structure is also provided for properly orienting and guiding the ram in its downward travel within the frame. The lower surface of the ram may also include grid recesses or grooves into which the cutting blades matably fit to both insure full sectioning of the lettuce head and to also optionally prevent contact and dulling of the blades against the ram. It is therefore an object of this invention to provide an economical and simple, manually operated lettuce, cabbage or the like cutting device for producing a wide variety of sections from entire heads of lettuce or cabbage.

In accordance with this and other objects which will become apparent hereinafter, the instant invention will now be described with reference to the accompanying drawings.

DETAILED DESCRIPTION OF THE INVENTION

Figure 1:
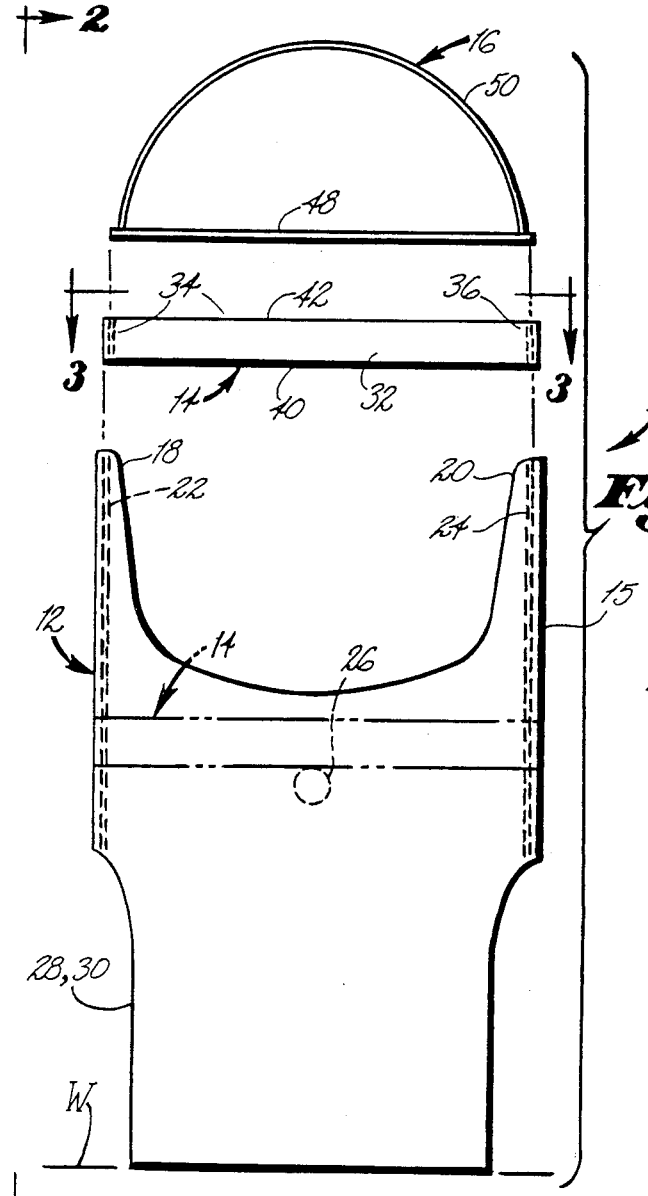
FIG. 1 is an exploded front elevation view of the invention.
Figure 2:
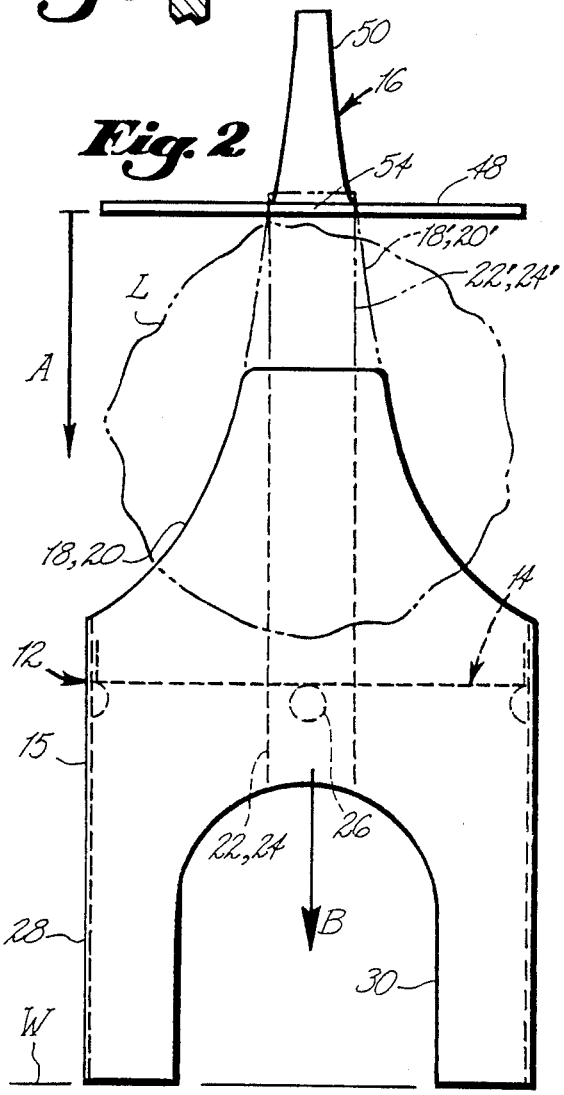
FIG. 2 is a side elevation view in the direction of arrows 2—2 in FIG. 1.

Referring now to the drawings, and particularly to FIGS. 1 and 2, the preferred embodiment of the invention is shown generally at numeral 10 and includes a frame 12, a removable cutting grid 14 and a ram or pusher shown generally at numeral 16.

The frame 12 is fabricated of a thin-walled rigid upright plastic or metal cylindrical tube 15 having upwardly extending support portions 18 and 20 and also having openings 28 and 30 disposed upwardly from the bottom of the cylindrical tube 15. Also included formed into the cylindrical tube 15 are a plurality of inward protrusions 26 which are aligned uniformly in height above a working surface W upon which the invention 10 rests so as to position and support the cutting grid 14 within the frame 12 as shown in phantom in FIG. 1 and as shown in dotted lines in FIG. 2.

Figure 4:
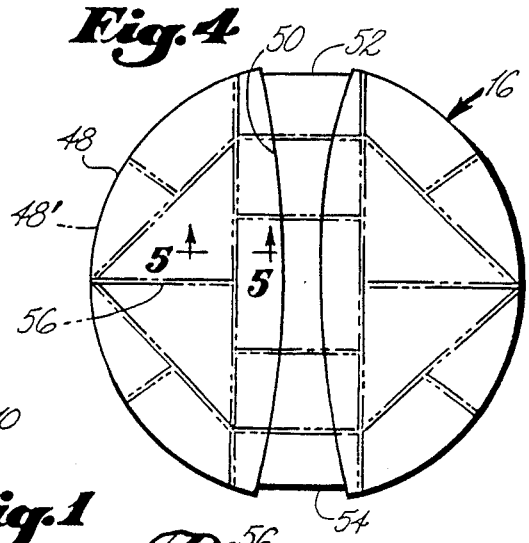
FIG. 4 is a top plan view of the ram and also showing an alternate embodiment of the plate lower surface in phantom.
Figure 3:
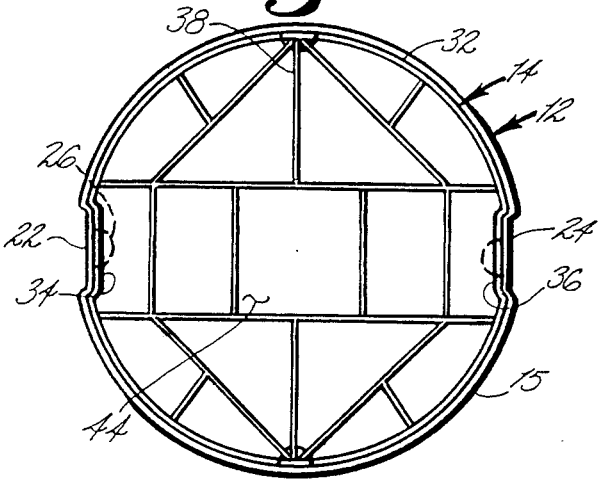
FIG. 3 is a top plan view in the direction of arrows 3—3 in FIG. 1.

Referring also to FIG. 3 and 4, the cutting grid 14 itself includes a circular perimeter band 32 which is sized to slidably engage within the tubular portion 15. Connected within the perimeter band 32 are a plurality of cutting blades shown typically at 38. These cutting blades 38 are positioned edgewise vertically and lengthwise transversely with respect to the length of the frame 12 such that their sharp cutting edges 42 are upwardly oriented. These plurality of cutting blades 38 typically are connected or may be molded of a single plastic unit so as to form a plurality of apertures shown generally at 44. These individual cutting blades 38 are uniquely oriented so that each of the apertures 44 typically are each of different geometric shape and size, i.e. rectangular, triangular and polygonal. This unique feature of the distinctiveness of each of the apertures 44 is provided so that the head of lettuce or cabbage to be sectioned by the device 10 will produce longitudinal segments of lettuce or cabbage which have distinctive appearance for variety of edibility and decorative distinctiveness between each section.

So as to insure proper alignment of the cutting grid 14, two recesses 34 and 36 are formed into the perimeter band 32 which matably and slidably engage with similarly shaped longitudinal recesses 22 and 24 formed into the entire length of tubular portion 15.

The ram 16 as best also seen in FIG. 4, includes a generally flat circular disc 48 which also includes recesses 52 and 54 which slidably and matably engage along the length of recesses 22 and 24 in tubular portion 15. A generally arched semicircular thin rigid handle 50 connected at each end adjacent recesses 52 and 54 is also provided to more easily facilitate the manual operation of the ram 16 in use.

As best seen in FIG. 2, a head of lettuce designated as L is placed atop cutting grid 14. Upwardly extending side support portions 18 and 20 help to insure that the head of lettuce L will not be dislodged or laterally disposed out of alignment with the cutting grid 14. The ram 16 is then grasped by handle 50 and downwardly forced against the top of the head of lettuce L in the direction of arrow A. As the head of lettuce L is passed through cutting grid 14, it is sectioned in accordance with the already-described apertures 44 typically downwardly below the cutting grid 14 in the direction of arrow B.

Note that, in the preferred embodiment, the cutting grid 14 is positioned a distance sufficiently above the working surface W so that the entire length of the sections of the head of lettuce L will pass through and be cut by the cutting blades 38 typically before contacting the working surface W. Openings 28 and 30 are provided to facilitate viewing and removal of the sections of lettuce which are deposited within the tubular portion 15 and beneath the cutting grid 14.

Likewise, and preferably, the support portions 18 and 20 may be upwardly extended as shown in phantom at 18' and 20', along with upwardly extended recesses 22' and 24' so that the recesses 52 and 54 of ram 16 will interengage with the recesses 22' and 24' so as to insure proper guidance and alignment of the ram 16 with respect to cutting grid 14 during the entire downward stroke in the direction of arrow A as the head of lettuce L is sliced.

Figure 5:
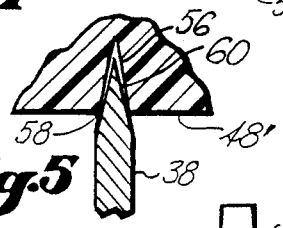
FIG. 5 is a section view in the direction of arrows 5—5 in FIG. 4 of the embodiment shown in phantom.

Referring lastly to FIGS. 4 and 5, an alternate embodiment 48' shown in phantom in FIG. 4 of the plate 48 is there shown. The lower surface of plate 48' includes a recess grid shown typically at 56 which is formed of a plurality of grooves into the lower surface of plate 48'. These grooves 56 are provided so as to insure that the upper cutting margins of cutting blades 38 typically fully cut and section the head of lettuce.

Additionally as best seen in FIG. 5, the grooves 56 are formed so as to contact the cutting edges 60 of cutting blades 38 so that the shoulder 58 of grooves 56 contacts the side of the cutting edge 60 to prevent contact of the upper most portion of cutting edge 60 does not contact the plate 48'.

It is noted that the preferred embodiment of the cutting edges of cutting blades 38 is in the form of a serrated edge as this form of cutting edge appears to be best suited for cutting and sectioning vegetables of all sorts, particularly lettuce and cabbage.

It is also here noted that, although the cutting grid 14 is preferably removable for cleaning and servicing purposes, it may also be rigidly fixed in place within the cylindrical tube 15 by rivetting or resistance welding and be within the intended scope of this invention.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A lettuce and vegetable cutting device comprising:

an upright generally cylindrical, very thin-walled tubular frame supportable atop a horizontal working surface, said frame having opposing upwardly extending support portions;

a cutting grid formed as a single member positioned horizontally at a mid point within said frame above the working surface for supportively receiving the head of lettuce, said grid having a plurality of connected cutting blades each having upwardly facing cutting edges which collectively define a first plane;

said cutting blades arranged within said grid to define a plurality of non-uniform apertures;

said support portions structured having opposing openings downwardly extending from the upper margin of said frame to laterally support and contain the head of lettuce therebetween and spaced for easy hand clearance and access to the head of lettuce atop said cutting grid;

a separate ram having a handle connected to a horizontal plate with a lower surface, said plate sized to slidably fit within said frame and to mate atop said cutting grid wherein said lower surface is against said cutting edges;

said rim manually forcing the head of lettuce downwardly through said apertures whereby the head of lettuce is sectioned into a plurality of non-uniform elongated segments;

said plate lower surface including a recess grid which collectively defines a second plane and formed of a plurality of grooves having a shallow depth in relation to the height of said cutting blades in alignment and registry with said cutting edges wherein said cutting edges are positioned within said grooves when said lower surface is atop and against said cutting edges;

said apertures in plan view being rectangular, triangular and polygonal in shape.

2. A lettuce and vegetable cutting device as set forth in claim 1, wherein:

said cutting grid is removable from said frame, said cutting grid vertically positionable and supported above the work surface for use within said frame by a plurality of protrusions inwardly extending from said frame inner surface to cooperatively contact said cutting grid.

3. A lettuce and vegetable cutting device as set forth in claim 2, further comprising:

guide and orientation means along the length of said frame which cooperatively mates with recess structure in the perimeter of said plate for properly orienting said ram to said frame and for maintaining the orientation as said ram is moved downwardly from the upper ends of said support portions toward said cutting edges.

4. A lettuce and vegetable cutting device as set forth in claim 3, wherein:

said support portions extend upwardly above said cutting grid an amount sufficient to allow said guide and orientation means to engage when the head of lettuce is positioned atop said cutting grid.

5. A lettuce and vegetable cutting device as set forth in claim 4, wherein:

said frame extends downwardly an amount sufficient to allow the entire head of lettuce to pass downwardly through said cutting grid before contacting the working surface.

6. A lettuce and vegetable cutting device as set forth in claim 5, wherein:

said frame includes opposing openings downwardly extending below said cutting grid to the working surface to provide easy hand clearance and access to the sectioned head of lettuce after passing through said cutting grid.

7. A lettuce and vegetable cutting device as set forth in claim 1, wherein:

said cutting edges are serrated.

8. A lettuce and vegetable cutting device as set forth in claim 1, wherein:

said grooves are formed to prevent contact of the upper most portion of said cutting edges with plate.

* * * * *